US011393401B2

(12) United States Patent
Choi et al.

(10) Patent No.: US 11,393,401 B2
(45) Date of Patent: Jul. 19, 2022

(54) DATA DRIVING CIRCUIT, CONTROLLER AND DISPLAY DEVICE

(71) Applicant: LG Display Co., Ltd., Seoul (KR)

(72) Inventors: Seongmin Choi, Paju-si (KR); Hyojung Park, Paju-si (KR); SeungHyuck Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/501,529

(22) Filed: Oct. 14, 2021

(65) Prior Publication Data

US 2022/0122540 A1 Apr. 21, 2022

(30) Foreign Application Priority Data

Oct. 16, 2020 (KR) ..... 10-2020-0134537

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0413* (2013.01); *G09G 2300/0842* (2013.01); *G09G 2310/08* (2013.01); *G09G 2320/0285* (2013.01); *G09G 2320/043* (2013.01)

(58) Field of Classification Search
CPC ..... G09G 2300/0413; G09G 3/006; G09G 3/3648; G09G 3/3291; G09G 2310/0232; G09G 2320/029; G09G 2320/043; G09G 2320/0285
See application file for complete search history.

(56) References Cited

U.S. PATENT DOCUMENTS

2005/0168138 A1* 8/2005 Okunaka ..... H01L 51/5259 313/504
2016/0005364 A1* 1/2016 Kobayashi ..... G09G 3/3648 345/206
2016/0027378 A1* 1/2016 Kim ..... G09G 3/3233 345/207
2016/0171931 A1* 6/2016 Liu ..... G09G 3/3208 345/694
2022/0036823 A1* 2/2022 Iwauchi ..... G09G 3/3233

* cited by examiner

*Primary Examiner* — Dong Hui Liang
(74) *Attorney, Agent, or Firm* — Seed IP Law Group LLP

(57) ABSTRACT

A data driving circuit, controller, and display device include a compensation table for compensating for degradation of a light emitting subpixel. The compensation table may be generated or updated based on degradation of a dummy subpixel. The dummy subpixel is disposed in a non-active area, and has the same or similar characteristics to those of the light emitting subpixel as the display device is driven. Degree of degradation of the dummy subpixel may be sensed, and by degrading the dummy subpixel more rapidly than the light emitting subpixel, accuracy of sensing may be enhanced. The degradation compensation is performed in real time during driving of the display device, and is based on the compensation table generated or updated using the degree of degradation sensed on the dummy subpixel.

19 Claims, 13 Drawing Sheets

DATA DRIVING CIRCUIT, CONTROLLER AND DISPLAY DEVICE

CROSS-REFERENCE TO RELATED APPLICATION

This application claims priority from Korean Patent Application No. 10-2020-0134537, filed on Oct. 16, 2020, which is hereby incorporated by reference for all purposes as if fully set forth herein.

BACKGROUND

Technical Field

Embodiments of the disclosure relate to a data driving circuit, a controller, and a display device.

Description of the Related Art

The growth of the information society leads to increased demand for image display devices and use of various types of display devices, such as liquid crystal displays, organic light emitting displays, etc.

A display device may include a display panel with multiple subpixels and various driving circuits for driving the subpixels. Further, at least one circuit element may be disposed in each of the plurality of sub-pixels.

BRIEF SUMMARY

The inventors have realized that, over time, as the driving time of the display device accumulates, circuit elements disposed in the subpixels may degrade. The degree of degradation may differ for the circuit element in each of different subpixels. Such a difference in the degree of degradation may cause non-uniform driving across the subpixels, with the result of poor display quality. Embodiments provide a method for preventing degradation of circuit elements in subpixels and deterioration of display quality due to the reasons just described.

According to embodiments of the disclosure, there is provided a method for compensating for degradation of a circuit element disposed in a subpixel of a display panel in real time while a display device is driven.

According to embodiments of the disclosure, there is provided a method for performing degradation compensation beneficial for a display panel while enhancing the accuracy of degradation compensation which is performed in real time while a display device is driven.

According to embodiments of the disclosure, there is provided a display device, comprising a plurality of light emitting subpixels disposed in an active area of a display panel and including a light emitting element and a driving transistor, at least one dummy subpixel disposed in a non-active area of the display panel and including a modeling transistor, a data driving circuit supplying a data voltage to at least one of the plurality of light emitting subpixels and the at least one dummy subpixel, and a controller controlling the data driving circuit.

The data driving circuit may supply a driving data voltage to at least one of the plurality of light emitting subpixels during a display driving period and supply a dummy data voltage larger than the driving data voltage to the at least one dummy subpixel during the display driving period.

The data driving circuit may sense a degree of degradation of the modeling transistor included in the dummy subpixel receiving the dummy data voltage during a sensing period.

The data driving circuit may include a first data driving circuit supplying the driving data voltage to the plurality of light emitting subpixels and a second data driving circuit supplying the dummy data voltage to the at least one dummy subpixel and sensing the degree of degradation of the modeling transistor included in the at least one dummy subpixel.

The controller may generate or update a compensation table including a compensation value corresponding to a stress value of the driving transistor if the data driving circuit senses the degree of degradation of the modeling transistor.

According to embodiments of the disclosure, there is provided a data driving circuit, comprising a driving data voltage supply unit supplying a driving data voltage to a plurality of light emitting subpixels disposed in an active area during a display driving period, a dummy data voltage supply unit supplying a dummy data voltage larger than the driving data voltage to at least one dummy subpixel disposed in a non-active area during the display driving period, and a sensing unit sensing a degree of degradation of a modeling transistor included in the at least one dummy subpixel during a sensing period separate from the display driving period.

According to embodiments of the disclosure, there is provided a controller, comprising a control unit receiving an image data signal, outputting a driving data signal to a data driving circuit, and receiving degree-of-degradation sensing data from the data driving circuit and a memory storing a compensation table including a first stress value, which increases according to the output of the driving data signal, a second stress value, which increases if the degree-of-degradation sensing data is received, and a compensation value corresponding to the first stress value.

The compensation table stored in the memory may be changed if the control unit receives the degree-of-degradation sensing data.

According to embodiments of the disclosure, it is possible to compensate for degradation of a subpixel in real time while the display device is driven by previously storing a compensation table including a compensation value corresponding to a stress value of the subpixel and compensating for the degradation of the subpixel based on the compensation table if the stress value of the subpixel increases.

According to embodiments of the disclosure, it is possible to enhance the accuracy of degradation compensation based on a compensation table by accelerating the degradation of a circuit element disposed in a dummy subpixel while the display device is driven and updating the compensation table based on degree-of-degradation sensing data obtained from the circuit element disposed in the dummy subpixel.

BRIEF DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Figure 1:
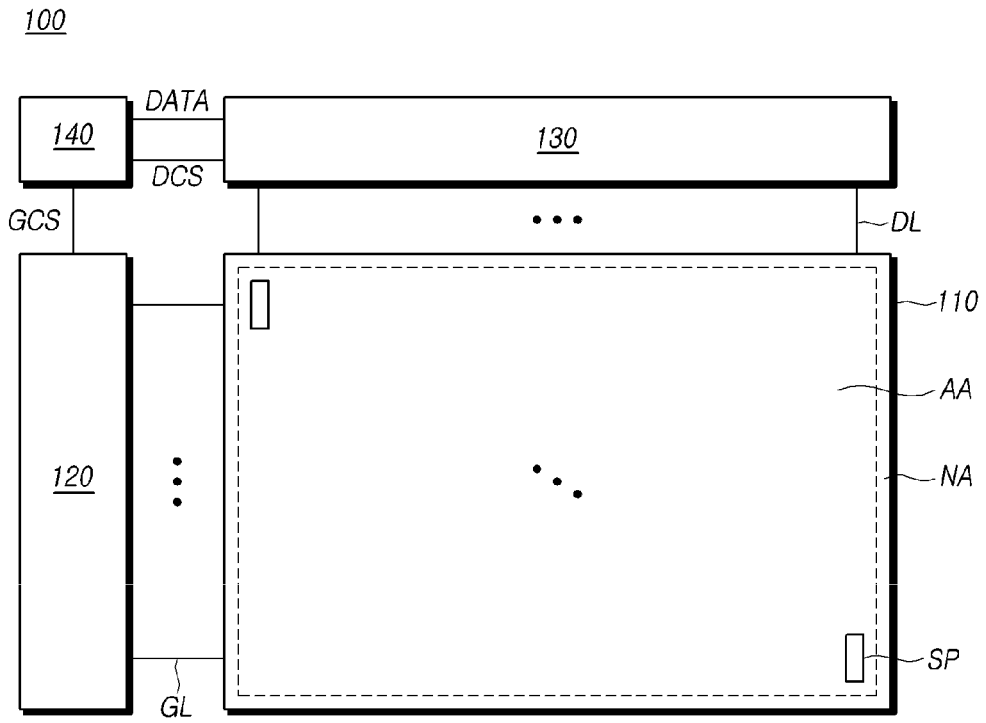
FIG. 1 is a view schematically illustrating a configuration of a display device according to embodiments of the disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms may not be used to impart essence, order, sequence, or number of elements, etc., but may be used to distinguish the corresponding element from other elements.

When it is mentioned that a first element "is connected or coupled to," "contacts or overlaps," etc., a second element, it should be interpreted that, the first element may be "be directly connected or coupled to" or "directly contact or overlap" the second element, or a third element can also be "interposed" between the first and second elements, or the first and second elements can "be connected or coupled to," "contact or overlap," etc., each other via a fourth element. Here, the second element may be included in at least one of two or more elements that "are connected or coupled to," "contact or overlap," etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

FIG. 1 is a view schematically illustrating a configuration of a display device 100 according to various embodiments of the disclosure.

Referring to FIG. 1, a display device 100 may include a display panel 110 and a gate driving circuit 120, a data driving circuit 130, and a controller 140 for driving the display panel 110.

The display panel 110 may include an active area AA in which a plurality of subpixels SP are disposed and a non-active area NA positioned outside the active area AA.

The display panel 110 may include a plurality of gate lines GL, a plurality of data lines DL, and subpixels SP at the crossings of the gate lines GL and the data lines DL.

The gate driving circuit 120 may be controlled by the controller 140 to sequentially output scan signals to the plurality of gate lines GL disposed in the display panel 110, controlling the driving timing of the subpixels SP.

The gate driving circuit 120 may include one or more gate driver integrated circuits (GDICs). Depending on driving schemes, the gate driving circuit 120 may be positioned on only one side, or each of two opposite sides, of the display panel 110.

Each gate driver integrated circuit (GDIC) may be connected to the bonding pad of the display panel 110 in a tape automated bonding (TAB) or chip-on-glass (COG) scheme or may be implemented in a gate-in-panel (GIP) type to be directly disposed in the display panel 110 or, in some cases, may be integrated in the display panel 110. Each gate driver integrated circuit (GDIC) may also be implemented in a chip-on-film (COF) scheme to be mounted on a film connected to the display panel 110.

The data driving circuit 130 receives image data from the controller 140 and converts the image data into an analog data voltage Vdata. The data driving circuit 130 outputs the data voltage Vdata to each data line DL according to the timing of applying a scan signal via the gate line GL, allowing each subpixel SP to represent a brightness according to the image data.

The data driving circuit 130 may include one or more source driver integrated circuits (SDICs).

Each source driver integrated circuit (SDIC) may include, e.g., shift registers, latch circuits, digital-analog converters, and output buffers.

Each source driver integrated circuit (SDIC) may be connected to the bonding pad of the display panel 110 in a TAB or COG scheme or may be directly disposed in the display panel 110 or, in some cases, may be integrated in the display panel 110. Each source driver integrated circuit (SDIC) may be implemented in a COF scheme in which case each source driver integrated circuit (SDIC) may be mounted on a film connected to the display panel 110 and be electrically connected with the display panel 110 via wires on the film.

The controller 140 supplies various control signals to the gate driving circuit 120 and the data driving circuit 130 and controls the operation of the gate driving circuit 120 and the data driving circuit 130.

The controller 140 may be mounted on a printed circuit board or a flexible printed circuit and may be electrically connected with the gate driving circuit 120 and the data driving circuit 130 through the printed circuit board or the flexible printed circuit.

The controller 140 enables the gate driving circuit 120 to output scan signals according to the timing of implementing each frame, converts image data received from the outside to meet the data signal format used by the data driving circuit 130, and outputs the resultant image data to the data driving circuit 130.

The controller 140 receives, from the outside (e.g., a host system), various timing signals including a vertical synchronization signal VSYNC, a horizontal synchronization signal HSYNC, an input data enable signal DE, and a clock signal, along with the image data.

The controller 140 may generate a diversity of control signals using the timing signals received from the outside and output the control signals to the gate driving circuit 120 and the data driving circuit 130.

As an example, to control the gate driving circuit 120, the controller 140 outputs various gate control signals GCS including a gate start pulse GSP, a gate shift clock GSC, and a gate output enable signal GOE.

The gate start pulse GSP controls the operation start timing of one or more gate driver integrated circuits GDICs constituting the gate driving circuit 120. The gate shift clock GSC is a clock signal commonly input to one or more gate driver integrated circuits GDICs and controls the shift timing of the scan signals. The gate output enable signal GOE designates timing information about one or more gate driver integrated circuits GDICs.

To control the data driving circuit 130, the controller 140 outputs various data control signals DCS including, e.g., a source start pulse SSP, a source sampling clock SSC, and a source output enable signal SOE.

The source start pulse SSP controls the data sampling start timing of one or more source driver integrated circuits SDICs constituting the data driving circuit 130. The source sampling clock SSC is a clock signal for controlling the sampling timing of data in each source driver integrated circuit (SDIC). The source output enable signal SOE controls the output timing of the data driving circuit 130.

The display device 100 may further include a power management integrated circuit that supplies various voltages or currents to, e.g., the display panel 110, the gate driving circuit 120, and the data driving circuit 130 or controls various voltages or currents to be supplied.

Each subpixel SP may be positioned in and occupy an area of overlap of the gate line GL and the data line DL, and at least one circuit element including a light emitting element may be disposed therein.

For example, if the display device 100 is an organic light emitting display device, organic light emitting diodes (OLEDs) and several circuit elements may be disposed in the plurality of subpixels SP. Each subpixel SP may display a brightness corresponding to image data by controlling the current supplied to the OLED disposed in the subpixel SP by several circuit elements.

In some cases, a light emitting diode (LED) or micro light emitting diode (μLED) may be disposed in each subpixel SP.

Figure 2:
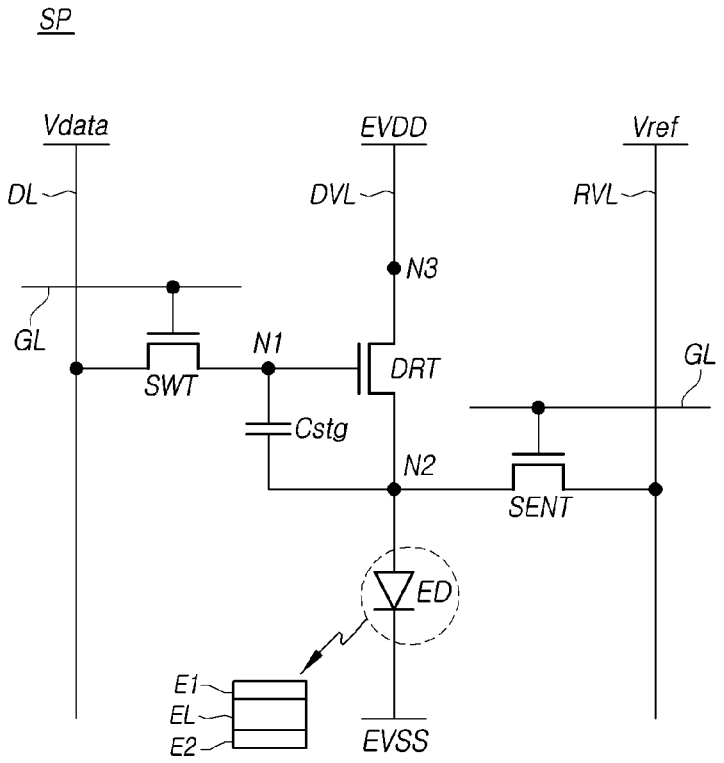
FIG. 2 is a view illustrating an example circuit structure of a subpixel included in a display device according to embodiments of the disclosure.

FIG. 2 is a view illustrating an example circuit structure of a subpixel SP included in a display device 100 according to embodiments of the disclosure.

Referring to FIG. 2, a light emitting element ED and a driving transistor DRT for driving the light emitting element ED may be disposed in a subpixel SP. In addition to the light emitting element ED and the driving transistor DRT, at least one circuit element may be disposed in the subpixel SP.

As an example, as illustrated in FIG. 2, a switching transistor SWT, a sensing transistor SENT, and a storage capacitor Cstg may be further disposed in the subpixel SP.

Although FIG. 2 illustrates a 3T1C structure in which three thin film transistors and one capacitor are disposed in the subpixel SP in addition to the light emitting element ED as an example, embodiments of the disclosure are not limited thereto. Further, although in the example illustrated in FIG. 2, all of the thin film transistors are of N-type, the thin film transistors disposed in the sub-pixel SP may be of P-type in some cases.

The switching transistor SWT may be electrically connected between a data line DL and a first node N1. A data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may control application of the data voltage Vdata, which is supplied through the data line DL, to the gate node of the driving transistor DRT.

The driving transistor DRT may be electrically connected between a driving voltage line DVL and the light emitting element ED. A first driving voltage EVDD may be supplied to a third node N3 of the driving transistor DRT through a driving voltage line DVL. The first driving voltage EVDD may be a high potential driving voltage. The third node N3 may be a drain node or source node of the driving transistor DRT.

The driving transistor DRT may be controlled by a voltage applied to the first node N1. The driving transistor DRT may control the driving current supplied to the light emitting element ED.

The sensing transistor SENT may be electrically connected between a reference voltage line RVL and a second node N2. A reference voltage Vref may be supplied to the second node N2 through the reference voltage line RVL. The second node N2 may be a source node or drain node of the driving transistor DRT.

The sensing transistor SENT may be controlled by a scan signal supplied to the gate line GL. The gate line GL controlling the sensing transistor SENT may be the same as, or different from, the gate line GL controlling the switching transistor SWT. The sensing transistor SENT may control to apply the reference voltage Vref to the second node N2. In some cases, the sensing transistor SENT may control to sense the voltage of the second node N2 through the reference voltage line RVL.

The storage capacitor Cstg may be electrically connected between the first node N1 and the second node N2. The storage capacitor Cstg may maintain the data voltage Vdata applied to the first node N1 for one frame.

The light emitting element ED may be electrically connected between the second node N2 and a line to which a second driving voltage EVSS is supplied. The second driving voltage EVSS may be a low potential driving voltage.

The light emitting element ED may include a first electrode layer E1 electrically connected with the second node N2, a second electrode layer E2 electrically connected with a line to which the second driving voltage EVSS is supplied, and a light emitting layer EL disposed between the first electrode layer E1 and the second electrode layer E2.

The light emitting element ED may display a brightness according to the driving current supplied through the driving transistor DRT.

Therefore, in order for the sub-pixel SP to display a brightness according to image data, accurate control of the driving transistor DRT and the light emitting element ED is beneficial. However, as the driving time accumulates over the life of the display panel 110, a characteristic value of the driving transistor DRT or the light emitting element ED may be changed due to degradation.

For example, the threshold voltage or mobility of the driving transistor DRT may be changed. The threshold voltage of the light emitting element ED may be changed as well.

Due to a variation in the characteristic value of the driving transistor DRT or the light emitting element ED, a deviation in characteristic value may occur between the sub-pixels SP. The deviation in characteristic value between the sub-pixels SP may affect the quality (e.g., the uniformity) of the image displayed through the display panel 110.

Embodiments of the disclosure provide a method for preventing deterioration of display quality due to degradation of circuit elements disposed in the sub-pixel SP.

In the disclosure, the amount of variation in the characteristic value of the sub-pixel SP may mean the amount of degradation of the sub-pixel SP. The amount of degradation of the subpixel SP may mean the amount of variation in the characteristic value of at least one of the driving transistor DRT and the light emitting element ED disposed in the subpixel SP. The characteristic value may include one or more of the threshold voltage, mobility, or other similar characteristic values of the driving transistor DRT or the light emitting element ED, as mentioned above.

Figure 3:
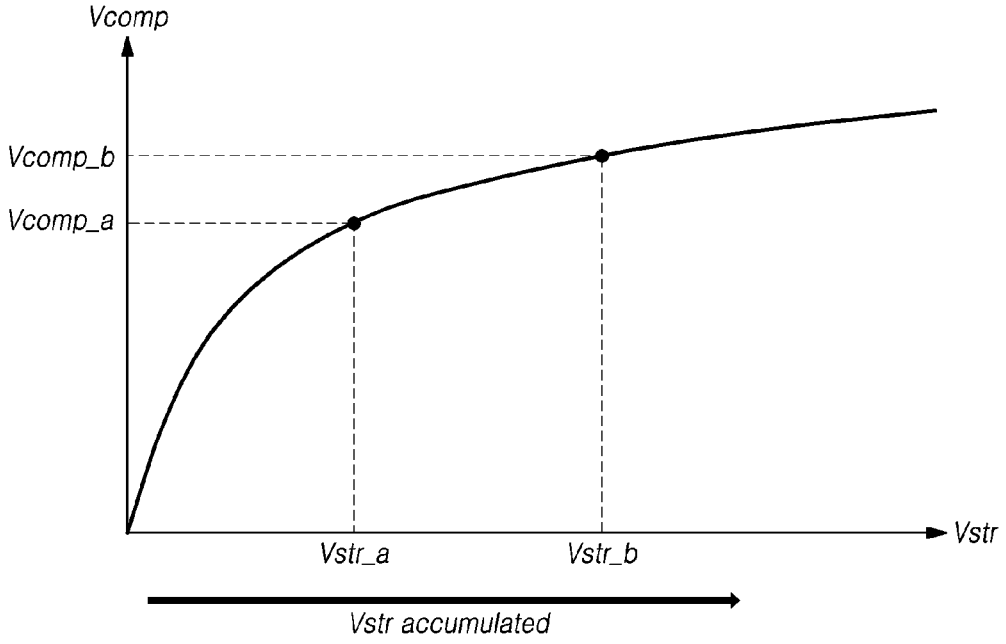
FIG. 3 is a view illustrating an example method for compensating for degradation of a subpixel included in a display device according to embodiments of the disclosure.

FIG. 3 is a view illustrating an example method for compensating for degradation of a subpixel SP included in a display device 100 according to embodiments of the disclosure.

Referring to FIG. 3, the display device 100 may store a compensation table including information for the relationship between the stress value Vstr corresponding to the degree of degradation of the subpixel SP and the compensation value Vcomp according to the stress value Vstr.

As an example, the compensation table may represent the relationship between the stress value Vstr and the compensation value Vcomp as in the graph of FIG. 3 and may be stored, in the form of a lookup table, in the display device 100.

The display device 100 may compensate for the degradation of the subpixel SP disposed in the display panel 110 based on information related to the relationship between the stress value Vstr and the compensation value Vcomp stored in the compensation table.

If display driving starts, the display device 100 may accumulate the stress value Vstr of the subpixel SP according to the display driving. The display device 100 may identify the compensation value Vcomp corresponding to the accumulated stress value Vstr in the compensation table and perform compensation for the degraded subpixel SP using the identified compensation value Vcomp.

As an example, depending on the time when compensation is performed, the display device 100 may perform compensation using Vcomp_a which is the compensation value Vcomp corresponding to Vstr_a if the stress value Vstr of the subpixel SP is Vstr_a and perform compensation using Vcomp_b which is the compensation value Vcomp corresponding to Vstr_b if the stress value Vstr of the subpixel SP is Vstr_b.

The display device 100 may identify the stress value Vstr according to the subpixel SP to be compensated for and may perform compensation for the degradation of the subpixel SP using the compensation value Vcomp corresponding to the stress value Vstr. In other words, proper compensation may be performed on subpixels SP that have different degrees of degradation.

As the display device 100 is driven, the stress value Vstr for each subpixel SP is accumulated, and compensation is performed using the compensation value Vcomp determined based on the compensation table and the accumulated stress value Vstr, so that compensation for the degradation of the subpixel SP may be performed in real time while the display device 100 is driven.

It is thus possible to prevent quality deterioration of the display due to the degradation of the display device 100 by compensating for the degradation deviation between subpixels SP or the degradation of the subpixel SP according to the driving of the display device 100.

According to embodiments of the disclosure, the display device 100 may generate or update a compensation table using the dummy subpixel SP_dmy disposed in the non-active area NA of the display panel 110. It is therefore possible to perform adaptive, real-time compensation according to the display panel 110 while enhancing the accuracy of compensation for the degradation of the subpixel SP.

Figure 4:
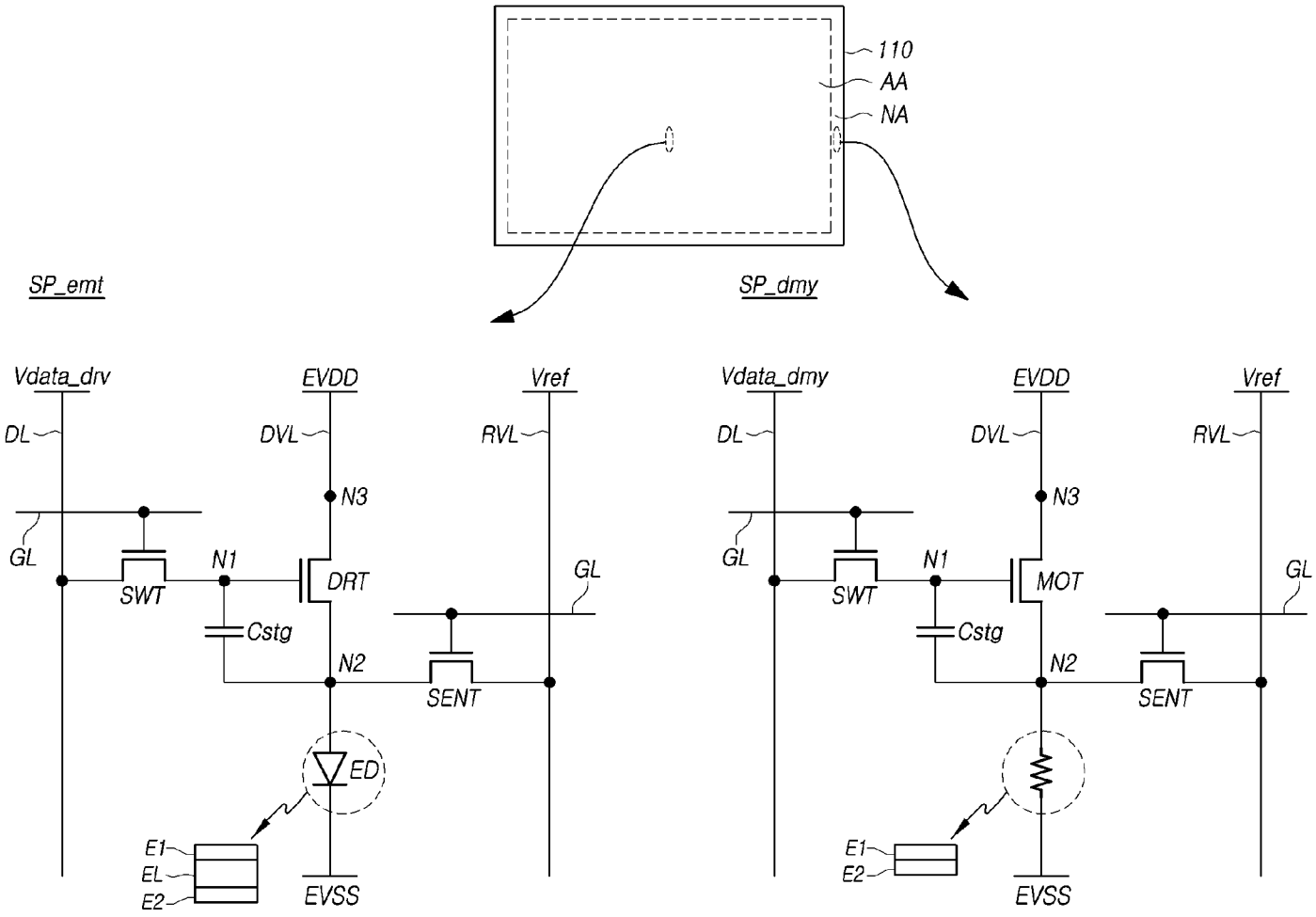
FIG. 4 is a view illustrating an example of a light emitting subpixel and a dummy subpixel included in a display device according to embodiments of the disclosure.

FIG. 4 is a view illustrating an example of a light emitting subpixel SP_emt and a dummy subpixel SP_dmy included in a display device 100 according to embodiments of the disclosure.

Referring to FIG. 4, a plurality of light emitting subpixels SP_emt may be disposed in the active area AA of the display panel 110. Like the subpixel SP described above, the light emitting subpixel SP_emt may be a subpixel SP in a 3T1C circuit structure which includes a light emitting element ED and a driving transistor DRT.

At least one dummy subpixel SP_dmy may be disposed in the non-active area NA of the display panel 110.

The dummy subpixel SP_dmy may be disposed in the non-active area NA, and may be disposed on at least one side of the upper, lower, left, and right sides of the active area AA.

The dummy subpixel SP_dmy may include the same circuit elements as those of the light emitting subpixel SP_emt except for the light emitting element ED. Accordingly, the dummy subpixel SP_dmy may include a gate line GL, a data line DL, a switching transistor SWT, a sensing transistor SENT, and a storage capacitor Cstg.

The dummy subpixel SP_dmy may include a modeling transistor MOT corresponding to the driving transistor DRT included in the light emitting subpixel SP_emt.

The dummy subpixel SP_dmy may include the first electrode layer E1 and the second electrode layer E2, except for the light emitting layer EL, among the first electrode layer E1, the light emitting layer EL, and the second electrode layer E2 included in the light emitting subpixel SP_emt. The first electrode layer E1 and the second electrode layer E2 included in the dummy subpixel SP_dmy may be electrically connected with each other. In one or more embodiments, the first electrode layer E1 is in contact with the second electrode layer E2 in the dummy subpixel SP_dmy, for example, with no intervening light emitting layer EL therebetween.

Since the light emitting layer EL is not disposed in the dummy subpixel SP_dmy, the dummy subpixel SP_dmy may not emit light even when a data voltage Vdata is supplied to the dummy subpixel SP_dmy. Since the modeling transistor MOT included in the dummy subpixel SP_dmy is disposed on the same substrate as the driving transistor DRT included in the light emitting subpixel SP_emt through the same process, the modeling transistor MOT may have properties similar to those of the driving transistor DRT.

Accordingly, the degradation tendency of the driving transistor DRT included in the light emitting subpixel SP_emt may be predicted using the modeling transistor MOT included in the dummy subpixel SP_dmy.

The display device 100 may change the compensation table indicating the compensation value Vcomp according to the stress value Vstr of the driving transistor DRT based on the degradation tendency predicted using the modeling transistor MOT included in the dummy subpixel SP_dmy.

The display device 100 may compensate for the degradation of the light emitting subpixel SP_emt using the changed compensation table, thereby enhancing the accuracy of degradation compensation and compensating for the degradation of light emitting subpixel SP_emt in real time.

For example, a driving data voltage Vdata_drv may be supplied to the light emitting subpixel SP_emt disposed in the active area AA during the display driving period. The stress value Vstr of the light emitting subpixel SP_emt may be accumulated according to the driving data voltage Vdata_drv.

A dummy data voltage Vdata_dmy may be supplied to the dummy subpixel SP_dmy disposed in the non-active area NA during the display driving period.

The dummy data voltage Vdata_dmy may be a voltage for accelerating degradation of the modeling transistor MOT disposed in the dummy subpixel SP_dmy. For example, the dummy data voltage Vdata_dmy may be higher than the driving data voltage Vdata_drv.

The display device 100 may detect the degree of degradation of the modeling transistor MOT included in the dummy subpixel SP_dmy during a degree-of-degradation sensing period. In other words, the display device 100 does not detect the degree of degradation of the driving transistor DRT included in the light emitting subpixel SP_emt, but may detect the degree of degradation of the modeling transistor MOT that has been more degraded than the driving transistor DRT.

The stress value Vstr of the dummy subpixel SP_dmy may be accumulated based on the dummy data voltage Vdata_dmy supplied to the dummy subpixel SP_dmy. By detecting the degree of degradation of the dummy subpixel SP_dmy, the compensation value Vcomp for the dummy subpixel SP_dmy may be calculated.

Accordingly, the display device 100 may generate a compensation table, or change a pre-stored compensation table, using the stress value Vstr of the dummy subpixel SP_dmy and the calculated compensation value Vcomp.

The display device 100 may compensate for degradation of the driving transistor DRT included in the light emitting subpixel SP_emt based on the compensation table obtained using the dummy subpixel SP_dmy.

Accordingly, the display device 100 may enhance the accuracy of degradation compensation and perform adaptive compensation according to the display panel 110 while compensating for degradation of the light emitting subpixel SP_emt in real time.

Figure 5:
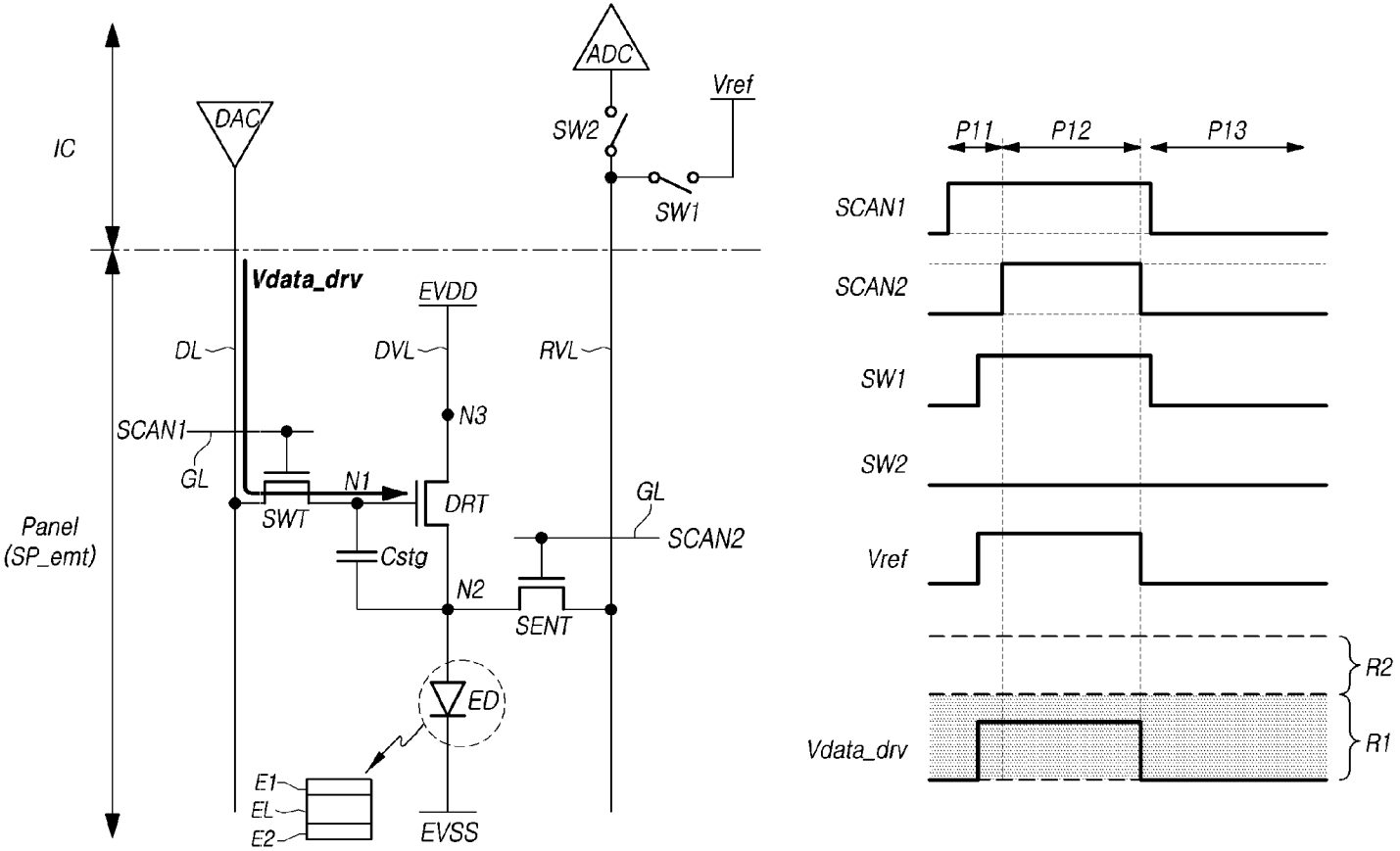
FIG. 5 is a view illustrating an example method for driving a light emitting subpixel during a display driving period of a display device according to embodiments of the disclosure.
Figure 6:
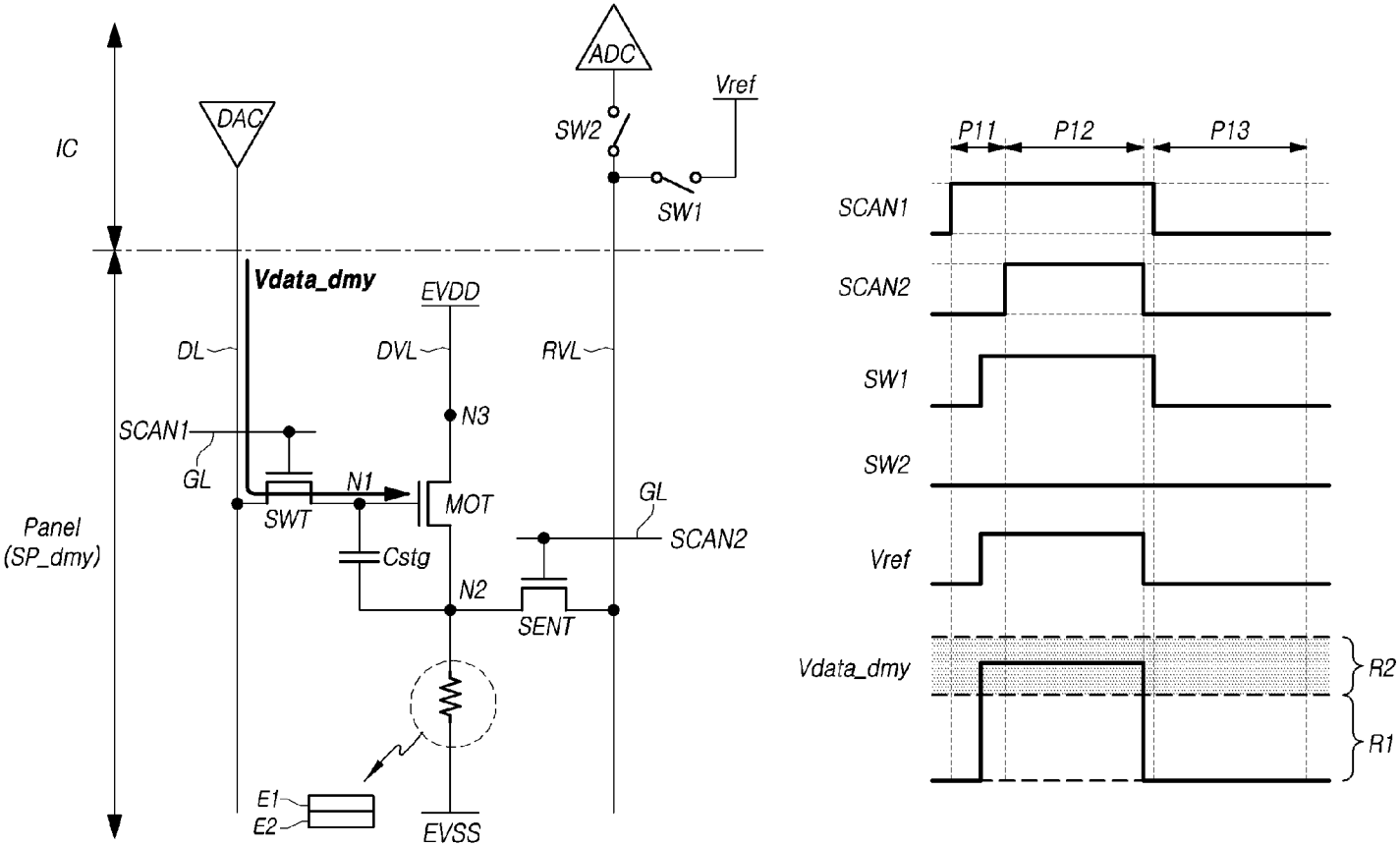
FIG. 6 is a view illustrating an example method for driving a dummy subpixel during a display driving period of a display device according to embodiments of the disclosure.
Figure 7:
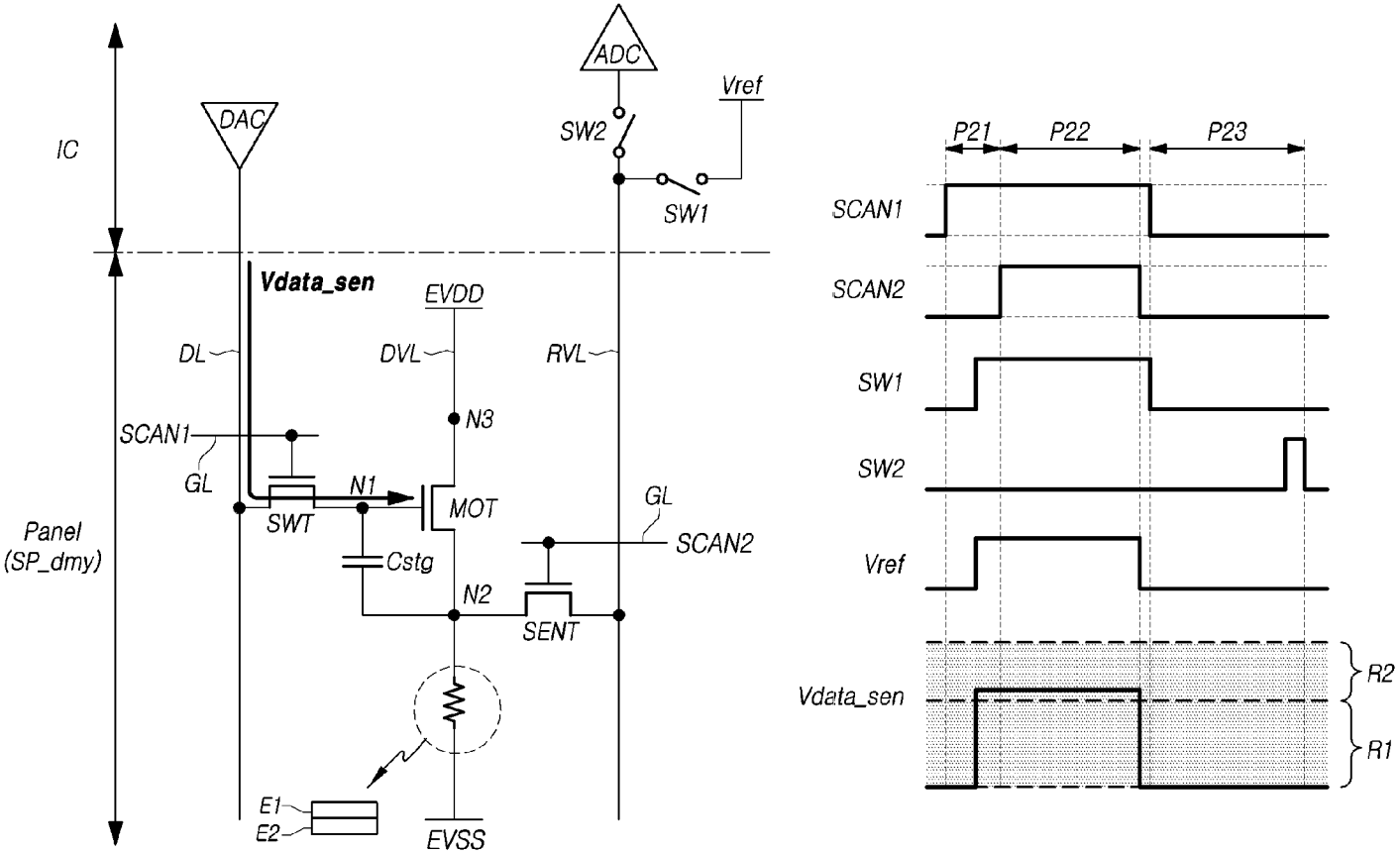
FIG. 7 is a view illustrating an example method for driving a dummy subpixel during a degree-of-degradation sensing period of a display device according to embodiments of the disclosure.

FIGS. 5 to 7 are views illustrating specific examples of a method for driving a light emitting subpixel SP_emt and a dummy subpixel SP_dmy included in a display device 100 according to embodiments of the disclosure.

FIG. 5 is a view illustrating an example method for driving a light emitting subpixel SP_emt during a display driving period of a display device 100 according to embodiments of the disclosure. FIG. 6 is a view illustrating an example method for driving a dummy subpixel SP_dmy during a display driving period of a display device 100 according to embodiments of the disclosure.

Referring to FIGS. 5 and 6, in a first period P11 of the display driving period, a turn-on level first scan signal SCAN1 may be supplied to the light emitting subpixel SP_emt, so that the switching transistor SWT may be turned on. Further, in the first period P11 of the display driving period, the turn-on level first scan signal SCAN1 may be supplied to the dummy subpixel SP_dmy.

The first period P11 of the display driving period may be referred to as an "initialization period."

The turn-on level first scan signal SCAN1 is maintained in a second period P12 of the display driving period. In the second period P12 of the display driving period, a turn-on level second scan signal SCAN2 may be supplied to the light emitting subpixel SP_emt. A first switch SW1 that controls the supply of a reference voltage Vref to the light emitting subpixel SP_emt may be turned on. In some cases, the first switch SW1 may be turned on in the first period P11 and maintain the turned-on state in the second period P12.

Since the switching transistor SWT and the sensing transistor SENT included in the light emitting subpixel SP_emt are turned on, the driving data voltage Vdata_drv and the reference voltage Vref may be supplied to the light emitting subpixel SP_emt.

Since the switching transistor SWT and the sensing transistor SENT included in the dummy subpixel SP_dmy are driven in the same or a similar manner to the light emitting subpixel SP_emt, the dummy data voltage Vdata_dmy and the reference voltage Vref may be supplied to the dummy subpixel SP_dmy.

The second period P12 of the display driving period may be referred to as a "programming period."

In a third period P13 of the display driving period, a turn-off level first scan signal SCAN1 and a turn-off level second scan signal SCAN2 may be supplied to the light emitting subpixel SP_emt and the dummy subpixel SP_dmy. The first switch SW1 may be turned off. The supply of the data voltage Vdata and the reference voltage Vref may be stopped.

The driving transistor DRT included in the light emitting subpixel SP_emt may supply a driving current according to the driving data voltage Vdata_drv to the light emitting element ED in the third period P13 of the display driving period. The light emitting element ED included in the light emitting subpixel SP_emt may represent a brightness according to the driving data voltage Vdata_drv.

The third period P13 of the display driving period may be referred to as a "light emitting period."

The modeling transistor MOT included in the dummy subpixel SP_dmy may output a driving current according to the dummy data voltage Vdata in the third period P13 of the display driving period. Since the dummy subpixel SP_dmy does not include a light emitting element ED, the dummy subpixel SP_dmy emits no light, and the modeling transistor MOT may be degraded.

Thus, it is possible to degrade the modeling transistor MOT by driving the dummy subpixel SP_dmy disposed in the non-active area NA during the display driving period when the light emitting subpixel SP_emt disposed in the active area AA is driven.

It is possible to generate or update a compensation table for the driving transistor DRT using the modeling transistor MOT by accelerating the degradation of the modeling transistor MOT over the degradation of the driving transistor DRT.

The driving data voltage Vdata_drv supplied to the light emitting subpixel SP_emt may be included in a first voltage range R1. The dummy data voltage Vdata_dmy supplied to the dummy subpixel SP_dmy may be included in a second voltage range R2 larger than the first voltage range R1.

For example, the upper limit of the second voltage range R2 may be larger than the upper limit of the first voltage range R1. The lower limit of the second voltage range R2 may be equal to or larger than the lower limit of the first voltage range R1.

It is possible to accelerate the degradation of the modeling transistor MOT included in the dummy subpixel SP_dmy by supplying the dummy data voltage Vdata_dmy higher than the driving data voltage Vdata_drv for driving the light emitting subpixel SP_emt.

The dummy data voltage Vdata_dmy is a fixed voltage included in the second voltage range R2 but, in some cases, the dummy data voltage Vdata_dmy may be a variable voltage.

As an example, the dummy data voltage Vdata_dmy may be larger when the driving time of the display device 100 is equal to or larger than a preset time or selected time than when the driving time of the display device 100 is less than the preset time or selected time. In other words, if the stress value Vstr indicating the degree of degradation of the modeling transistor MOT included in the dummy subpixel SP_dmy becomes a preset value or selected value or more, the dummy data voltage Vdata_dmy may increase.

It is possible to effectively accelerate the degradation of the modeling transistor MOT by varying the dummy data voltage Vdata_dmy depending on the degree of degradation of the modeling transistor MOT included in the dummy subpixel SP_dmy.

The display device 100 may generate or update a compensation table using the modeling transistor MOT by sensing the degree of degradation of the modeling transistor MOT which is further degraded than the driving transistor DRT.

FIG. 7 is a view illustrating an example method for driving a dummy subpixel SP_dmy during a degree-of-degradation sensing period of a display device 100 according to embodiments of the disclosure.

Referring to FIG. 7, a turn-on level first scan signal SCAN1 may be supplied to the dummy subpixel SP_dmy in a first period P21 of a degree-of-degradation sensing period. A turn-on level second scan signal SCAN2 may be supplied to the dummy subpixel SP_dmy in a second period P22 of the degree-of-degradation sensing period, so that the first switch SW1 may be turned on.

A sensing data voltage Vdata_sen may be supplied to a first node N1 that is the gate node of the modeling transistor MOT included in the dummy subpixel SP_dmy. A reference voltage Vref may be applied to a second node N2 that is the source node of the modeling transistor MOT.

In a third period P23 of the degree-of-degradation sensing period, a turn-off level first scan signal SCAN1 and a turn-off level second scan signal SCAN2 may be supplied to the dummy subpixel SP_dmy. The first switch SW1 may be turned off.

Accordingly, the first node N1 and the second node N2 of the modeling transistor MOT may be floated. The voltage of the second node N2 coupled to the first node N1 may increase according to the voltage of the first node N1.

Thereafter, if the voltage of the second node N2 is saturated, the second switch SW2 may be turned on so that the voltage of the second node N2 may be detected. It is possible to detect the threshold voltage of the modeling transistor MOT, e.g., the degree of degradation of the modeling transistor MOT, using the saturated voltage of the second node N2 and the sensing data voltage Vdata_sen.

The detection of the degree of degradation of the modeling transistor MOT may be performed, e.g., using an analog-to-digital converter (ADC) included in the data driving circuit 130, but is not limited thereto.

As such, it is possible to detect the degree of degradation of the modeling transistor MOT included in the dummy subpixel SP_dmy during the degree-of-degradation sensing period. It is possible to generate or update a compensation table for compensating for the degradation of the driving transistor DRT by detecting the degree of degradation of the modeling transistor MOT which has been further degraded than the driving transistor DRT requiring degradation compensation.

The light emitting subpixel SP_emt may not be driven during the degree-of-degradation sensing period.

As an example, neither a scan signal nor a data voltage Vdata may be supplied to the light emitting subpixel SP_emt during the degree-of-degradation sensing period. In one or more embodiments, not supplying the scan signal or the data voltage Vdata to the light emitting subpixel SP_emt during the degree-of-degradation sensing period may be or include supplying the scan signal and/or the data voltage Vdata at a selected voltage level, such as 0 Volts, or decoupling the scan signal and/or the data voltage Vdata by way of a switch, for example, that is open.

The degree-of-degradation sensing period is a period separate from the display driving period and may be a predetermined period or selected period after the display device 100 is turned on or after the display device 100 is turned off. Alternatively, in some cases, the degree-of-degradation sensing period may be a portion of the blank period during which no data voltage Vdata is supplied during the display driving period.

The sensing data voltage Vdata_sen may have a level set to sense the degree of degradation of the modeling transistor MOT. The sensing data voltage Vdata_sen may be a voltage included in at least one of a first voltage range R1 including the driving data voltage Vdata_drv and a second voltage range R2 including the dummy data voltage Vdata_dmy.

In other words, the dummy data voltage Vdata_dmy may be set to be higher than the driving data voltage Vdata_drv for accelerating degradation of the modeling transistor MOT, and the sensing data voltage Vdata_sen may be set as an appropriate level for sensing the degree of degradation of the modeling transistor MOT.

To prevent an excessive increase in the difference between the degree of degradation of the modeling transistor MOT and the degree of degradation of the driving transistor DRT while accelerating the degradation of the modeling transistor MOT over the degradation of the driving transistor DRT, the second voltage range R2 including the dummy data voltage Vdata_dmy may be set based on the distribution of the driving data voltage Vdata_drv.

Figure 8A:
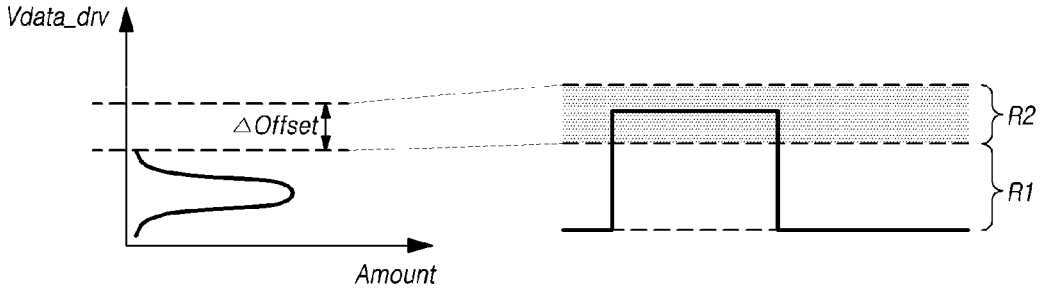
FIGS. 8A and 8B are views illustrating examples of a range of a driving data voltage supplied to a light emitting subpixel and a range of a dummy data voltage supplied to a dummy subpixel included in a display device according to embodiments of the disclosure.
Figure 8B:
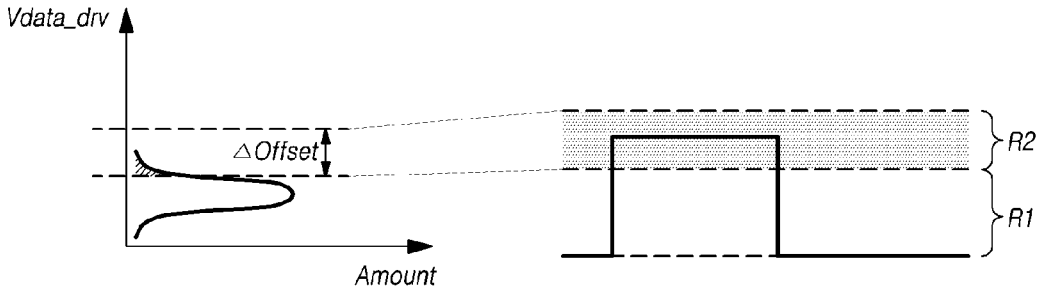

FIGS. 8A and 8B are views illustrating examples of a range of a driving data voltage Vdata_drv supplied to a light emitting subpixel SP_emt and a range of a dummy data voltage Vdata_dmy supplied to a dummy subpixel SP_dmy included in a display device according to embodiments of the disclosure.

Referring to FIG. 8A, the display device 100 may calculate the distribution of the driving data voltage Vdata_drv supplied to the light emitting subpixel SP_emt disposed in the whole or part of the active area AA during the display driving period.

The first voltage range R1 including the driving data voltage Vdata_drv may be determined based on the calculated distribution of the driving data voltage Vdata_drv.

The second voltage range R2 including the dummy data voltage Vdata_dmy may be a range in which an offset ΔOffset is added to the determined upper limit value of the first voltage range R1. In other words, the upper limit of the second voltage range R2 may be larger than the upper limit of the first voltage range R1. The lower limit of the second voltage range R2 may be substantially equal to or slightly above the upper limit of the first voltage range R1.

It is possible to prevent an excessive increase in degree-of-degradation difference between the dummy subpixel SP_dmy and the light emitting subpixel SP_emt by setting the dummy data voltage Vdata_dmy as a value larger than the driving data voltage Vdata_drv within a range corresponding to the offset ΔOffset.

As another example, referring to FIG. 8B, the display device 100 may calculate the distribution of the driving data voltage Vdata_drv supplied to the light emitting subpixel SP_emt disposed in the whole or part of the active area AA during the display driving period.

The lower limit of the second voltage range R2 including the dummy data voltage Vdata_dmy may be a voltage corresponding to the top X % (e.g., 5%) in the distribution of the driving data voltage Vdata_drv. The upper limit value of the second voltage range R2 may be a value in which a preset or selected offset ΔOffset is added to the lower limit value of the determine second voltage range R2.

Thus, it is possible to accelerate degradation of the modeling transistor MOT driven by the dummy data voltage Vdata_dmy over the driving transistor DRT while minimizing or reducing the difference between the dummy data voltage Vdata_dmy and the driving data voltage Vdata_drv.

As such, according to embodiments of the disclosure, the display device 100 may accelerate the degradation of the modeling transistor MOT included in the dummy subpixel SP_dmy and detect the degree of degradation of the modeling transistor MOT.

It is also possible to enhance the accuracy of real-time compensation using a compensation table by generating or updating a compensation table for compensating for degradation of the driving transistor DRT included in the light emitting subpixel SP_emt based on information obtained using the modeling transistor MOT.

The driving and sensing of the dummy subpixel SP_dmy and the generation or update of a compensation table may be performed by the data driving circuit 130 and the controller 140 included in the display device 100.

Figure 9:
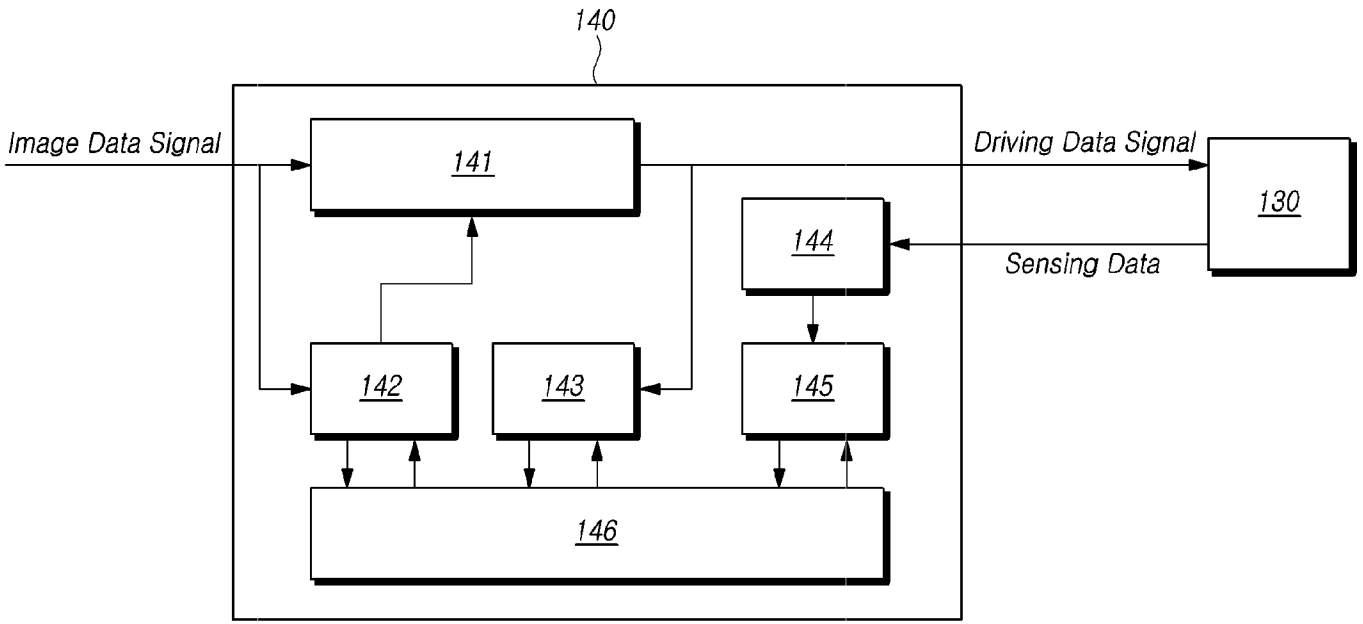
FIG. 9 is a view illustrating an example configuration of a controller included in a display device according to embodiments of the disclosure.

FIG. 9 is a view illustrating an example configuration of a controller 140 included in a display device 100 according to embodiments of the disclosure. In one or more embodiments, the controller 140 includes a controller circuit 140 and may be referred to as a controller circuit 140.

Referring to FIG. 9, a controller 140 may include a data signal output unit 141 that receives an image data signal from the outside and outputs a driving data signal to a data driving circuit 130. In one or more embodiments, the data signal output unit 141 includes a data signal output circuit 141 and may be referred to as a data signal output circuit 141.

The controller 140 may include a compensation unit 142 that identifies the compensation value Vcomp according to the image data signal and transmits the compensation value Vcomp to the data signal output unit 141. In one or more embodiments, the compensation unit 142 includes a compensation circuit 142 and may be referred to as a compensation circuit 142.

The controller 140 may include an accumulation unit 143 that receives the driving data signal, which the data signal output unit 141 outputs based on the image data signal and the compensation value Vcomp, and accumulates the stress value Vstr according to the driving data signal. In one or more embodiments, the accumulation unit 143 includes an accumulation circuit 143 and may be referred to as an accumulation circuit 143.

The controller 140 may include a sensing driving unit 144 that drives sensing of degree of degradation of the dummy subpixel SP_dmy and receives degree-of-degradation sensing data from the data driving circuit 130. In one or more embodiments, the sensing driving unit 144 includes a sensing driving circuit 144 and may be referred to as a sensing driving circuit 144.

The controller 140 may include a degradation model processing unit 145 that generates or updates a compensation table based on the accumulated stress value Vstr of the dummy subpixel SP_dmy and the degree-of-degradation sensing data received by the sensing driving unit 144. In one or more embodiments, the degradation model processing unit 145 includes a degradation model processing circuit 145 and may be referred to as a degradation model processing circuit 145.

The data signal output unit 141, the compensation unit 142, the accumulation unit 143, the sensing driving unit 144, and the degradation model processing unit 145 may be provided as individual logics, or two or more thereof may be integrated into a logic. Alternatively, the above-described components may be collectively regarded as a single control unit, or each component may include a plurality of logics.

The controller 140 may include a memory 146 that stores the stress value Vstr of the subpixel SP disposed in the display panel 110, the compensation value Vcomp according to the stress value Vstr, and the compensation table representing the relationship between the stress value Vstr and the compensation value Vcomp.

The memory 146 may be disposed inside the controller 140 or outside the controller 140 according to circumstances.

If the data signal output unit 141 of the controller 140 outputs a driving data signal, the accumulation unit 143 accumulates the stress value Vstr of the subpixel SP. Accordingly, the stress value Vstr stored in the memory 146 may increase. The stress values Vstr stored in the memory 146 may include the stress value Vstr of the light emitting subpixel SP_emt and the stress value Vstr of the dummy subpixel SP_dmy.

The driving data signal output from the data signal output unit 141 to the data driving circuit 130 may include information indicating the driving data voltage Vdata_drv supplied to the light emitting subpixel SP_emt and the dummy data voltage Vdata_dmy supplied to the dummy subpixel SP_dmy.

Accordingly, both the stress value Vstr of the light emitting subpixel SP_emt and the stress value Vstr of the dummy subpixel SP_dmy may increase based on the driving data signal.

Further, the increase rate of the stress value Vstr of the dummy subpixel SP_dmy may be larger than the increase rate of the stress value Vstr of the light emitting subpixel SP_emt.

Figure 10:
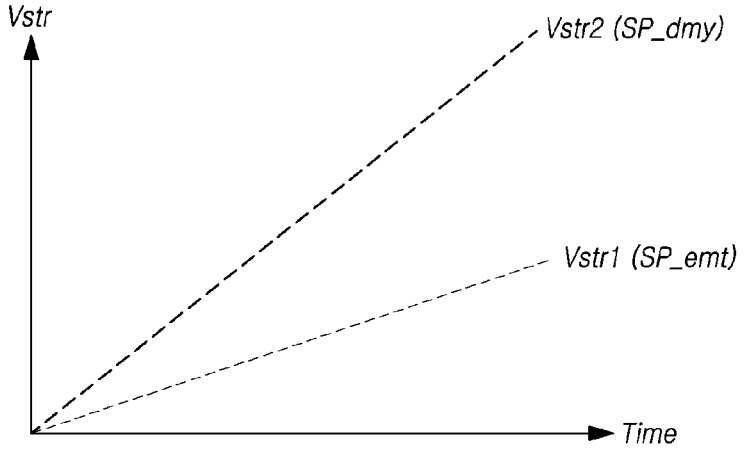
FIG. 10 is a view illustrating an example of changes, over time, in the stress value of a light emitting subpixel and the stress value of a dummy subpixel included in a display device according to embodiments of the disclosure.

FIG. 10 is a view illustrating an example of changes, over time, in the stress value Vstr of a light emitting subpixel SP_emt and the stress value Vstr of a dummy subpixel SP_dmy included in a display device 100 according to embodiments of the disclosure.

Referring to FIG. 10, as the driving time of the display device 100 increases, the first stress value Vstr1 of the light emitting subpixel SP_emt may increase. The second stress value Vstr2 of the dummy subpixel SP_dmy may increase as well.

Since the dummy data voltage Vdata_dmy higher than the driving data voltage Vdata_drv supplied to the light emitting subpixel SP_emt is supplied to the dummy subpixel SP_dmy for accelerating degradation of the dummy subpixel SP_dmy, the increase rate of the second stress value Vstr2 of the dummy subpixel SP_dmy may be larger than that of the first stress value Vstr1 of the light emitting subpixel SP_emt.

The sensing driving unit 144 of the controller 140 may control the data driving circuit 130 during the degree-of-degradation sensing period, thereby receiving the degree-of-degradation sensing data of the dummy subpixel SP_dmy.

The degradation model processing unit 145 of the controller 140 may generate or update a compensation table using the second stress value Vstr2 of the dummy subpixel SP_dmy stored in the memory 146 and the degree-of-degradation sensing data obtained by the sensing driving unit 144.

For example, the degradation model processing unit 145 may calculate the degree of degradation of the modeling transistor MOT included in the dummy subpixel SP_dmy using the degree-of-degradation sensing data. The degradation model processing unit 145 may calculate the compensation value Vcomp based on the calculated degree of degradation.

Since the second stress value Vstr2 of the modeling transistor MOT included in the dummy subpixel SP_dmy is stored in the memory 146, it is possible to generate or update a compensation table using the stored second stress value Vstr2 and the calculated compensation value Vcomp.

Compensation for the degradation of the light emitting subpixel SP_emt may be performed based on the first stress value Vstr1 and the compensation table generated or updated.

In other words, it is possible to generate or update the compensation table based on the degree-of-degradation sensing data sensed from the dummy subpixel SP_dmy and the second stress value Vstr2 according to the acceleration of degradation of the dummy subpixel SP_dmy. Since it is the light emitting subpixel SP_emt that is subjected to degradation compensation, degradation compensation may be performed based on the compensation table and the first stress value Vstr1.

The compensation table stored in the memory 146 may be updated by the degradation model processing unit 145, with the compensation table stored in the memory 146. Alternatively, a compensation table to be stored in the memory 146 may be generated by the degradation model processing unit 145, with no compensation table stored in the memory 146.

Since degradation of the dummy subpixel SP_dmy proceeds earlier than degradation of the light emitting subpixel SP_emt, it is possible to generate a compensation table for compensation for degradation of the light emitting subpixel SP_emt and compensate for the light emitting subpixel SP_emt using information about the degradation of the dummy subpixel SP_dmy that has been done as the display device 100 is driven during a predetermined period or selected period.

Figure 11:
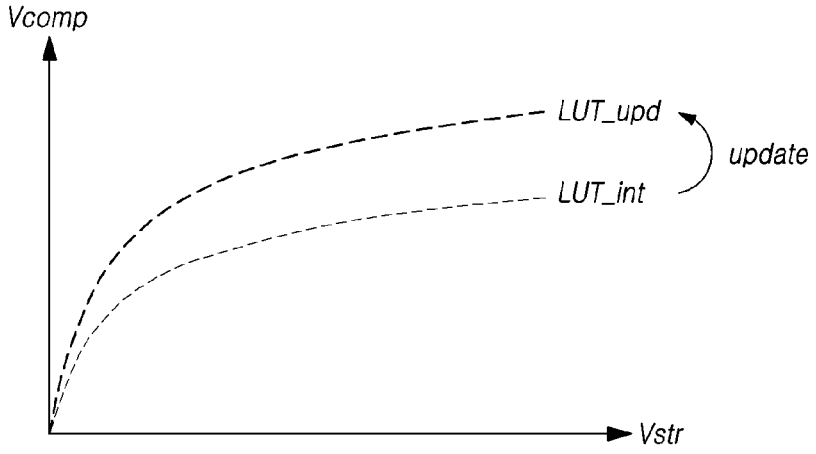
FIG. 11 is a view illustrating an example method for updating a compensation table by a controller included in a display device according to embodiments of the disclosure.

FIG. 11 is a view illustrating an example method for updating a compensation table by a controller 140 included in a display device 100 according to embodiments of the disclosure.

Referring to FIG. 11, degradation compensation may be performed based on an initial compensation table LUT_int stored in the memory 146 before the controller 140 obtains a compensation table using the dummy subpixel SP_dmy.

As the display device 100 is driven, the subpixel SP and the dummy subpixel SP_dmy may be degraded at different rates. If the degree of degradation of the dummy subpixel SP_dmy which has been further degraded is detected, a changed compensation table LUT_upd may be obtained based on the degree-of-degradation sensing data of the dummy subpixel SP_dmy and the stress value Vstr of the dummy subpixel SP_dmy.

Accordingly, the previously stored initial compensation table LUT_int may be updated to the changed compensation table LUT_upd.

The controller 140 may perform real-time degradation compensation for the light emitting subpixel SP_emt based on the changed compensation table LUT_upd.

It is possible to enhance the accuracy of real-time degradation compensation by performing degradation compensation for the driving transistor DRT based on the changed compensation table LUT_upd obtained via acceleration of degradation of the modeling transistor MOT having the same or similar characteristics to the driving transistor DRT included in the light emitting subpixel SP_emt.

Figure 12:
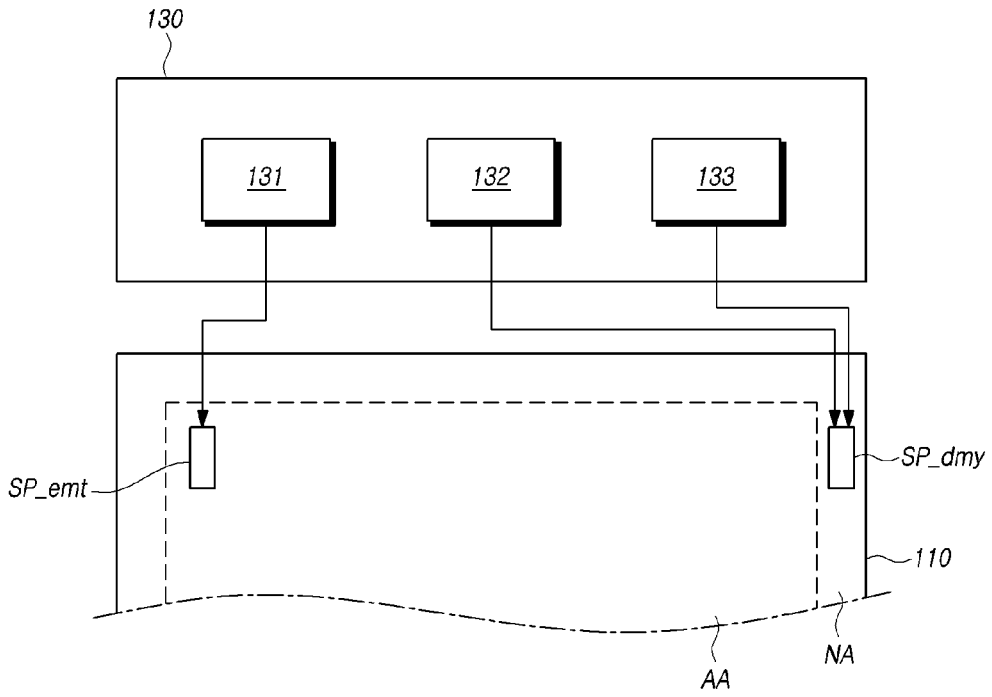
FIG. 12 is a view illustrating an example configuration of a data driving circuit included in a display device according to embodiments of the disclosure.

FIG. 12 is a view illustrating an example configuration of a data driving circuit 130 included in a display device 100 according to embodiments of the disclosure.

Referring to FIG. 12, the data driving circuit 130 may include a driving data voltage supply unit 131, a dummy data voltage supply unit 132, and a sensing unit 133.

The driving data voltage supply unit 131 may supply a driving data voltage Vdata_drv to a plurality of light emitting subpixels SP_emt disposed in the active area AA during a display driving period.

The dummy data voltage supply unit 132 may supply a dummy data voltage Vdata_dmy larger than the driving data voltage Vdata_drv to at least one dummy subpixel SP_dmy disposed in the non-active area NA during the display driving period. The dummy data voltage supply unit 132 may supply a sensing data voltage Vdata_sen to the dummy subpixel SP_dmy during a degree-of-degradation sensing period.

The sensing unit 133 may sense the degree of degradation of the modeling transistor MOT included in the dummy subpixel SP_dmy during the degree-of-degradation sensing period.

The driving data voltage supply unit 131, the dummy data voltage supply unit 132, and the sensing unit 133 may be controlled by one or more signals received from the controller 140.

The driving data voltage supply unit 131, the dummy data voltage supply unit 132, and the sensing unit 133 may be all included in one data driving circuit 130 or may be included in different data driving circuits 130.

For example, the data driving circuit 130 may include a first data driving circuit including the driving data voltage supply unit 131 and a second data driving circuit including the dummy data voltage supply unit 132 and the sensing unit 133. In other words, the configuration for driving the light emitting subpixel SP_emt and the configuration for driving the dummy subpixel SP_dmy may be integrated or separately disposed.

In some cases, the sensing unit 133 may be included in the data driving circuit 130 or, in other cases, the sensing unit 133 may be located outside the data driving circuit 130.

According to the above-described embodiments of the disclosure, as the controller 140 drives the light emitting subpixel SP_emt by applying the compensation value Vcomp according to the compensation table and the stress value Vstr accumulated according to the driving data signal output to the data driving circuit 130, it is possible to compensate for degradation of the light emitting subpixel SP_emt in real time.

It is also possible to more precisely predict the degradation tendency of the light emitting subpixel SP_emt by degrading the dummy subpixel SP_dmy more rapidly than the degradation of the light emitting subpixel SP_emt and sensing the degree of degradation of the dummy subpixel SP_dmy accelerated for degradation.

It is therefore possible to enhance the accuracy of degradation compensation while compensating for degradation of the light emitting subpixel SP_emt in real time while the display is driven, by periodically updating the compensation table for compensating for degradation of the light emitting subpixel SP_emt via detection of degree of degradation and acceleration of degradation of the dummy subpixel SP_dmy.

The above description has been presented to enable any person skilled in the art to make and use the technical idea of the present disclosure, and has been provided in the context of a particular application and its technical benefits. Various modifications, additions and substitutions to the described embodiments will be readily apparent to those skilled in the art, and the general principles described herein may be applied to other embodiments and applications without departing from the spirit and scope of the present disclosure. The above description and the accompanying drawings provide an example of the technical idea of the present disclosure for illustrative purposes. That is, the disclosed embodiments are intended to illustrate the scope of the technical idea of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a plurality of light emitting subpixels disposed in an active area of a display panel, each of the plurality of light emitting subpixels including a light emitting element;

at least one dummy subpixel disposed in a non-active area of the display panel, each of the at least one dummy subpixel including a modeling transistor;

a data driving circuit configured to supply a data voltage to at least one of the plurality of light emitting subpixels and the at least one dummy subpixel; and a controller controlling the data driving circuit, wherein the data driving circuit, in operation, supplies a driving data voltage to at least one of the plurality of light emitting subpixels during a display driving period, and supplies a dummy data voltage larger than the driving data voltage to the at least one dummy subpixel during the display driving period, and the data driving circuit, in operation, senses a degree of degradation of the modeling transistor included in the dummy subpixel receiving the dummy data voltage during a sensing period different from the display driving period.

2. The display device of claim 1, wherein the controller increases a first stress value when the data driving circuit supplies the driving data voltage, and increases a second stress value when receiving degree-of-degradation sensing data according to sensing the degree of degradation from the data driving circuit, and wherein an increase rate of the second stress value is larger than an increase rate of the first stress value.

3. The display device of claim 2, wherein the controller generates or updates a compensation table including a compensation value corresponding to a stress value of the driving transistor based on the second stress value and the degree-of-degradation sensing data and provides compensation data based on the compensation table and the first stress value.

4. The display device of claim 2, wherein the dummy data voltage supplied to the at least one dummy subpixel when the second stress value is not less than a selected value is larger than the dummy data voltage supplied to the at least one dummy subpixel when the second stress value is less than the selected value.

5. The display device of claim 1, wherein the driving data voltage is included in a first voltage range, and the dummy data voltage is included in a second voltage range, and wherein an upper limit of the second voltage range is larger than an upper limit of the first voltage range.

6. The display device of claim 5, wherein a lower limit of the second voltage range is not smaller than the upper limit of the first voltage range.

7. The display device of claim 1, wherein the data driving circuit does not supply the driving data voltage to the plurality of light emitting subpixels during the sensing period and supplies a sensing data voltage to the at least one dummy subpixel during the sensing period.

8. The display device of claim 1, wherein each subpixel includes a driving transistor and the controller generates or updates a compensation table including a compensation value corresponding to a stress value of the driving transistor when the data driving circuit senses the degree of degradation of the modeling transistor.

9. The display device of claim 1, wherein the dummy data voltage supplied to the at least one dummy subpixel when a driving time of the display panel is not less than a selected value is larger than the dummy data voltage supplied to the at least one dummy subpixel when the driving time is less than the selected value.

10. The display device of claim 1, wherein the light emitting element includes a first electrode layer, a second electrode layer, and a light emitting layer between the first electrode layer and the second electrode layer, and wherein the at least one dummy subpixel includes the first electrode layer and the second electrode layer electrically connected to the first electrode layer, and the first electrode layer and the second electrode layer in the dummy subpixel are electrically connected with each other.

11. The display device of claim 1, wherein the data driving circuit includes:

a first data driving circuit configured to supply the driving data voltage to the plurality of light emitting subpixels; and a second data driving circuit configured to supply the dummy data voltage to the at least one dummy subpixel and sense the degree of degradation of the modeling transistor included in the at least one dummy subpixel.

12. A data driving circuit, comprising:

a driving data voltage supply unit configured to supply a driving data voltage to a plurality of light emitting subpixels disposed in an active area during a display driving period;

a dummy data voltage supply unit configured to supply a dummy data voltage larger than the driving data voltage to at least one dummy subpixel disposed in a non-active area during the display driving period; and a sensing unit configured to sense a degree of degradation of a modeling transistor included in the at least one dummy subpixel during a sensing period separate from the display driving period.

13. The data driving circuit of claim 12, wherein the driving data voltage supply unit does not supply the driving data voltage to the plurality of light emitting subpixels during the sensing period, and the dummy data voltage supply unit supplies a sensing data voltage to the at least one dummy subpixel during the sensing period.

14. The data driving circuit of claim 13, wherein the sensing data voltage is included in at least one of a first voltage range including the driving data voltage and a second voltage range including the dummy data voltage.

15. The data driving circuit of claim 12, wherein the dummy data voltage supplied when the degree of degradation of the modeling transistor is not less than a selected value is larger than the dummy data voltage supplied when the degree of degradation of the modeling transistor is less than the selected value.

16. A controller, comprising:

a control unit receiving an image data signal, outputting a driving data signal to a data driving circuit, and receiving degree-of-degradation sensing data from the data driving circuit; and a memory storing a compensation table including:

a first stress value, wherein the first stress value increases according to the output of the driving data signal;

a second stress value, wherein the second stress value increases when the degree-of-degradation sensing data is received; and a compensation value corresponding to the first stress value, wherein the compensation table is changed when the control unit receives the degree-of-degradation sensing data.

17. The controller of claim 16, wherein the compensation table is changed when the control unit receives first degree-of-degradation sensing data and is changed when the control unit receives second degree-of-degradation sensing data in a period different from a period during which the first degree-of-degradation sensing data is received, and the compensation table maintains a constant value between the period during which the first degree-of-degradation sensing data is received and the period during which the second degree-of-degradation sensing data is received.

18. The controller of claim 16, wherein the compensation table is changed based on the degree-of-degradation sensing data and the second stress value, and wherein the driving data signal is determined based on the image data signal and a compensation value corresponding to the first stress value in the compensation table.

19. The controller of claim 16, wherein an increase rate of the second stress value is larger than an increase rate of the first stress value.

* * * * *